US012091925B2

(12) United States Patent
Alqahtani et al.

(10) Patent No.: US 12,091,925 B2
(45) **Date of Patent: *Sep. 17, 2024**

(54) FISHING WELDING TOOL

(71) Applicant: SAUDI ARABIAN OIL COMPANY, Dhahran (SA)

(72) Inventors: Abdulaziz D. Alqahtani, Dammam (SA); Omar M. Alhamid, Dammam (SA); Muaath S. Bajunaid, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 18/465,943

(22) Filed: Sep. 12, 2023

(65) Prior Publication Data

US 2023/0417117 A1 Dec. 28, 2023

Related U.S. Application Data

(62) Division of application No. 17/652,430, filed on Feb. 24, 2022, now Pat. No. 11,840,901.

(51) Int. Cl.
*E21B 31/00* (2006.01)
*E21B 47/18* (2012.01)

(52) U.S. Cl.
CPC ..... *E21B 31/007* (2013.01); *E21B 47/18* (2013.01)

(58) Field of Classification Search
CPC ..... E21B 31/007; E21B 47/18
See application file for complete search history.

(56) References Cited

U.S. PATENT DOCUMENTS 1,567,109 A * 12/1925 Boynton ..... E21B 31/007 294/86.1
2,154,654 A * 4/1939 Armentrout ..... E21B 31/007 219/148
2,789,004 A * 4/1957 Foster ..... E21B 31/007 164/DIG. 12
4,488,747 A * 12/1984 Austin ..... E21B 47/09 294/86.1
6,041,860 A * 3/2000 Nazzal ..... E21B 33/127 73/152.01
10,807,189 B2 * 10/2020 Huang ..... C06B 33/00
(Continued)

*Primary Examiner* — Tara Schimpf
*Assistant Examiner* — Neel Girish Patel
(74) *Attorney, Agent, or Firm* — Osha Bergman Watanabe & Burton LLP

(57) ABSTRACT

A welding tool consisting of a tubular body having a lateral end and a pin end. The pin end has external threads disposed around an external circumferential surface of the pin end. The lateral end comprises an inner wall defining an orifice. Additionally, a heat proof shell is disposed circumferentially around the lateral end. The welding tool further includes a battery housing. The battery housing encloses a plurality of batteries which store energy. The welding tool further includes a welding element disposed on an inner surface of the orifice and an electric line. The electric line is coiled within the tubular body and physically contacts the welding element and is electrically connected to the plurality of batteries. The welding tool further includes a controller. The controller is capable of receiving and parsing mud pulse signals and controlling the release of stored energy from the batteries to the electric line.

10 Claims, 5 Drawing Sheets

(56) References Cited

U.S. PATENT DOCUMENTS

| | | | | |
|---|---|---|---|---|
| 11,624,252 | B1 * | 4/2023 | Al-Mousa | E21B 31/002<br>166/55.6 |
| 2018/0038171 | A1 * | 2/2018 | Hall | E21B 17/028 |
| 2021/0254420 | A1 * | 8/2021 | Skjeie | E21B 33/134 |
| 2021/0270103 | A1 * | 9/2021 | Greci | E21B 31/007 |

* cited by examiner

FISHING WELDING TOOL

CROSS-REFERENCE TO RELATED APPLICATIONS

This Application is a Division of application Ser. No. 17/652,430 filed on Feb. 24, 2022. The entire contents of these applications are incorporated herein by reference in their entirety.

BACKGROUND

In the oil and gas industry, hydrocarbons are located in porous formations far beneath the Earth's surface. Wells are drilled into these formations to access and extract these hydrocarbons.

Oftentimes, during drilling of the well or throughout the life of the well, equipment or junk becomes lost or lodged in the well. This equipment or junk, once lost or lodged in the well, is called a fish. A "fishing job" involves removing the fish from the well, or otherwise clearing the well of the fish.

Common fishing procedures may include using fishing tools to latch onto the fish in order to pull the fish out of the well, or using milling tools to mill (i.e., drill through) the fish to clear the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments and disclosed, generally relating to a welding tool consisting of a tubular body having a lateral end and a pin end, wherein the pin end has external threads disposed around an external circumferential surface of the pin end and the lateral end comprises an inner wall defining an orifice. Additionally, a heat proof shell is disposed circumferentially around the lateral end. The welding tool further includes a battery housing, wherein the battery housing encloses a plurality of batteries which store energy. The welding tool further includes a welding element disposed on an inner surface of the orifice and an electric line. The electric line is coiled within the tubular body and physically contacts the welding element and is electrically connected to the plurality of batteries. The welding tool further includes a controller, wherein the controller is capable of receiving and parsing mud pulse signals and controlling the release of stored energy from the batteries to the electric line.

Embodiments and disclosed, generally relating to a method for performing a fishing operation. The method includes providing a welding tool which consists of a tubular body having a lateral end and a pin end, wherein the tubular body defines an orifice. The welding tool further includes a battery housing, wherein the battery housing encloses a plurality of batteries. Additionally, the welding tool has a welding element disposed on an inner surface of the orifice, and an electric line coiled within the tubular body and in direct contact with the welding element. The method further includes connecting the welding tool to a deployment device and lowering the welding tool into the well and onto a fish in the well such that the welding tool at least partially envelopes the fish. The method further includes activating the electric line to generate heat which welds the fish to the welding element of the welding tool. The method further includes raising the welding tool and removing the fish attached via weld to the welding tool from the well.

Embodiments and disclosed, generally relating to a system composed of a deployment device, a welding tool, and a controller. The welding tool consists of a tubular body having a lateral end and a pin end, wherein the tubular body defines an orifice. The welding tool further includes a battery housing, wherein the battery housing encloses a plurality of batteries. The welding tool further includes a welding element disposed on an inner surface of the orifice, and an electric line coiled within the tubular body and in direct contact with the welding element. The controller can receive and parse mud pulse signals and activate the electric line of the welding tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawings.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to a fishing welding tool intended to catch fish. The tool provides the ability to engage the top of the fish properly regardless of how the top of the fish is shaped, i.e., fish that may not be uniformly shaped at the top. Such a tool saves rig time by applying a unique procedure and tool that ensures engagement with the fish on the first attempt to retrieve the fish.

Figure 1:
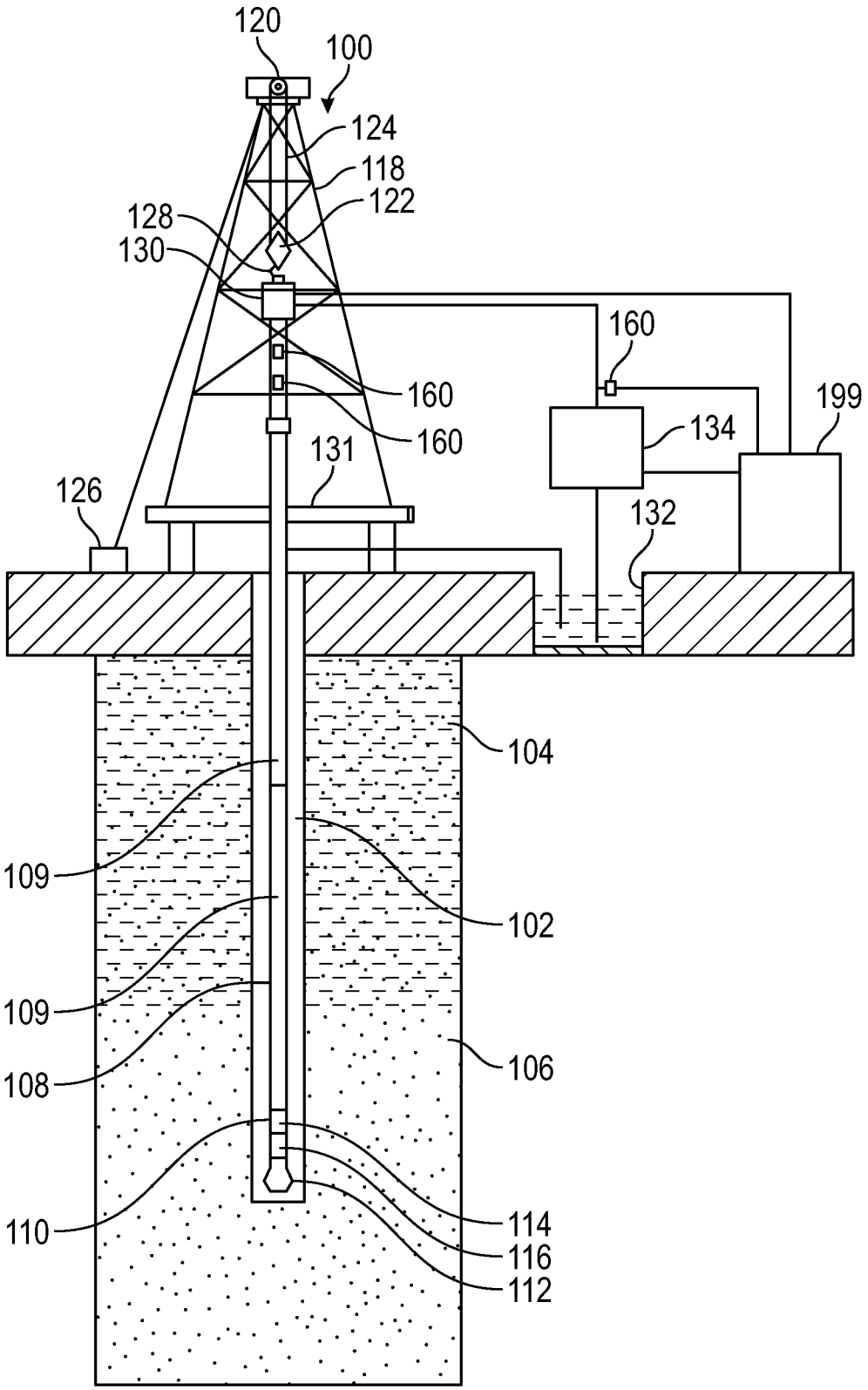
FIG. 1 shows an exemplary well site in accordance with one or more embodiments.

FIG. 1 illustrates an exemplary well site (100). In general, well sites may be configured in a myriad of ways. Therefore, the illustrated well site (100) of FIG. 1 is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104, 106). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. The BHA (110) and the drill string (108) may include other drilling tools known in the art but not specifically shown.

The drill string (108) may be suspended in the wellbore (102) by a derrick (118). A crown block (120) may be mounted at the top of the derrick (118), and a traveling block (122) may hang down from the crown block (120) by means of a cable or drilling line (124). One end of the cable (124) may be connected to a drawworks (126), which is a reeling device that may be used to adjust the length of the cable (124) so that the traveling block (122) may move up or down the derrick (118). The traveling block (122) may include a hook (128) on which a top drive (130) is supported.

The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel if a rotary table is used instead of a top drive to rotate the drill string (108)).

In one implementation, a system (199) may be disposed at or communicate with the well site (100). System (199) may control at least a portion of a drilling operation at the well site (100) by providing controls to various components of the drilling operation. In one or more embodiments, the system (199) may receive data from one or more sensors (160) arranged to measure controllable parameters of the drilling operation. As a nonlimiting example, sensors (160) may be arranged to measure WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired quantity.

During a drilling operation at a well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor (not shown). In other embodiments, the drill bit (112) may be rotated using a combination of the drilling motor and the top drive (130) (or a rotary swivel if a rotary table is used instead of a top drive to rotate the drill string (108)). While cutting rock with the drill bit (112), mud is pumped into the drill string (108).

The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the mud pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

While drilling the wellbore (102), as described above, various pieces of equipment such as the drill bit (112) or a portion of the drill string (108) may be disconnected from the surface portion of the well site (100) (surface portion being on or above the surface of the Earth) and be lost to the downhole portion of the well site (100) (downhole portion being anywhere beneath the surface of the Earth). The downhole portion of the well site (100) is hereafter referred to as the well. Equipment or junk that is lost or lodged in the well is called a fish. A fish may come from a drilling operation as described above, or a fish may come from any other operation without departing from the scope of this disclosure.

The fish may be fished or drilled out to clear the well for production and/or continuing operations. For a fishing job to be successful, the fishing tool must engage the top of the fish, or the accessible portion of the fish, with enough force to pull the fish out of the well. However, in many instances, the top of the fish is non-uniform, or otherwise shaped, such that engaging the fish is difficult, time-consuming, and oftentimes unfeasible. With respect to drilling the fish out of the well, a mill is used in place of a conventional drill bit (112). A mill is designed to drill through tougher materials, such as steel, when compared to a conventional drill bit (112). Mills are available in a plurality of different mill shapes depending on the shape of the fish. However, because it is difficult to know the shape of the fish and its orientation while the fish is downhole, the wrong mill shape may be selected resulting in a failed fishing job and additional costs, in both time and money, to select and try a different mill shape. Therefore, a fishing tool that can successfully remove, or otherwise clear the well of, the fish regardless of the shape and orientation of the fish is beneficial. As such, embodiments disclosed herein present systems and methods for a welding tool used for fishing operations that is agnostic to the shape and orientation of the downhole fish.

Figure 2C:
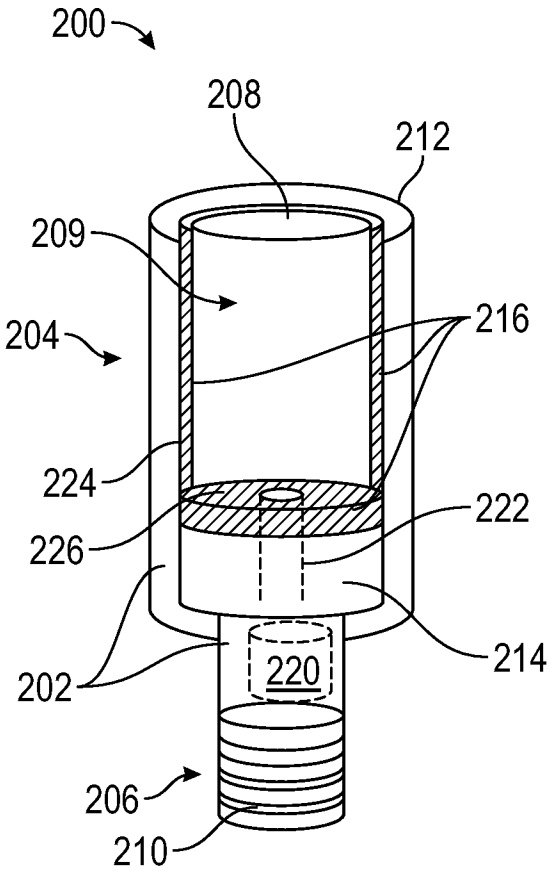
FIGS. 2A, 2B, and 2C depict a welding tool in accordance with one or more embodiments.
Figure 2B:
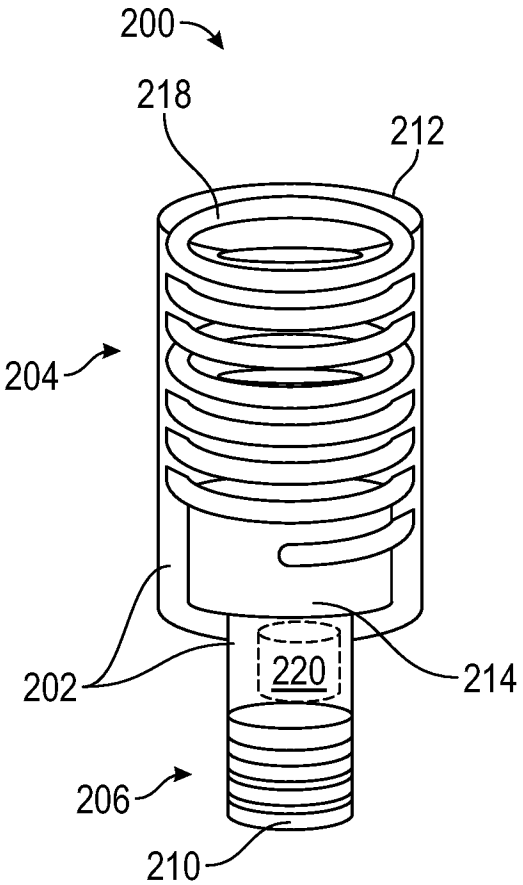
Figure 2A:
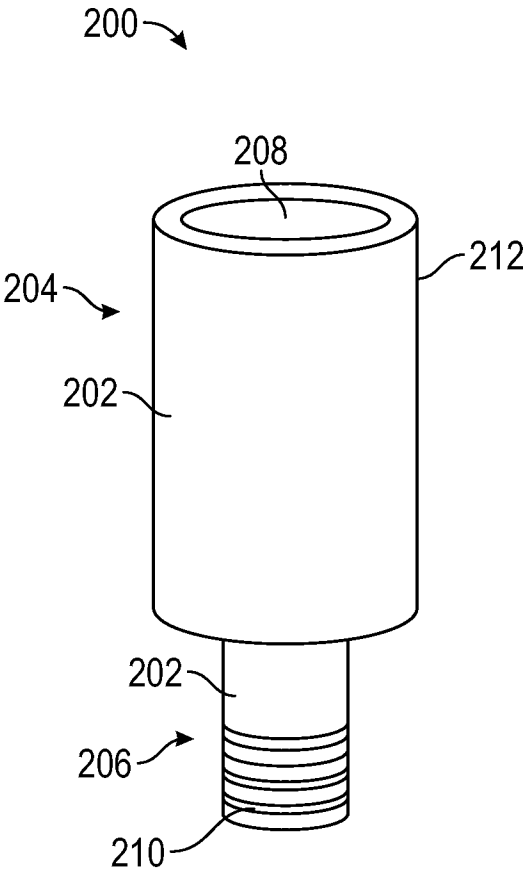

FIGS. 2A, 2B, and 2C depict a welding tool (200) for a fishing operation in accordance with one or more embodiments. More specifically, FIG. 2A shows an external view of the welding tool (200), while FIGS. 2B and 2C demonstrate internal portions of the welding tool (200). The welding tool (200) is made of a tubular body (202). The tubular body (202) may be made of any suitable durable material, such as steel-4140 alloy. The tubular body (202) is divided into two sections: a lateral end (204) and a pin end (206). In one or more embodiments, the pin end (206) and the lateral end (204) may have different outer diameters, as shown in FIGS. 2A, 2B, and 2C. Alternatively, the pin end (206) and lateral end (204) may be the same size making the two sections indistinguishable from one another.

Because the lateral end (204) and pin end (206) have a tubular shape, the lateral end (204) has an inner wall (208) defining an orifice (209). The pin end (206) has external threads (210) disposed around an external circumferential surface of the pin end (206). The external threads (210) may be any type of thread known in the art, such as box threads, tapered threads, etc.

As shown in FIG. 2B, an electric line (218), shaped to form a coil, resides within the lateral end (204) of the welding tool (200). More specifically, because the lateral end (204) is tubular and forms an orifice (209), the electric line (218) is disposed within the annular body of the lateral end (204) and encircles the orifice (209). The electric line (218) may be a coiled wire and is electrically connected to a plurality of batteries which reside in a battery housing (214). The battery housing (214) may be disposed in the lateral end (204), as shown in FIG. 2B, or the pin end (206). The plurality of batteries serve to store energy and may be any type of energy storage device known in the art, such as quick discharge batteries, or capacitors. The energy stored within the plurality of batteries may be discharged to the electric line (218) as controlled by a controller (220).

The controller (220) may be disposed within the tubular body (202) of the welding tool (200). In accordance with one or more embodiments, FIGS. 2B and 2C depict the controller (220) residing within the pin end (206) of the welding tool (200), however, the controller may reside in the lateral end (204) of the welding tool (200) or elsewhere in the BHA (110) without departing from the scope described herein. In addition to controlling the release of stored energy from the plurality of batteries to the electric line (218), the controller (220) is capable of receiving and parsing mud pulse signals. Using mud pulses, or mud pulse signals, is a well-known telemetry method to communicate with, or send information to, downhole equipment from the surface. Mud pulse signals may also be used to send information from downhole tools to the surface. As such, a mud pulse signal may be sent from the surface and received by the controller (220) wherein the mud pulse signal may indicate to the controller (220) to release the stored energy from the plurality of batteries to the electric line (218).

Further, FIG. 2C demonstrates a welding element (216) disposed on the inner surface area of the orifice (209) of the lateral end (204) of the welding tool (200). The welding element (216) is labelled more granularly as having a side welding element (224), which is disposed on the inner wall (208) of the orifice (209), and a base welding element (226), which resides at the base of the orifice (209), where the base is at the end of the orifice (209) opposing the open portion of the orifice (209).

The welding element (216) is waterproof and is able to operate in hyperbaric conditions such that contact with drilling fluid (drilling mud) does not inhibit its function. In one or more embodiments, the welding element (216) makes physical contact with the electric line (218). Because the electric line (218) and welding element (216) directly contact each other, when stored energy is discharged to the electric line (218), the welding element (216) is temporarily heated and melted. Additionally, external items encompassed by the orifice (209) and therefore proximate to the welding element (216), such as a fish or portions of a fish, may be temporarily heated and melted. The temporarily melted portions of the welding element (216) and nearby fish, once solidified, form a strong, fixed, welded connection between the welding tool (200) and the fish. In other words, once the electric line (218) is activated, by receiving stored energy from the plurality of batteries, as directed by the controller (220) upon reception of an indicative mud pulse signal, the welding tool (200) and any proximate fish become fixedly connected via a weld formed between the welding element (216) and the fish.

As shown in FIGS. 2A, 2B, and 2C, the lateral end (204) of the welding tool (200) is enclosed by a heat proof shell (212). The heat proof shell (212) insulates items external to the orifice (209) from heating and melting upon activation of the electric line (218) and welding element (216). As such, the heat proof shell (212) prevents the unwanted welding of the welding tool (200) to members external to the orifice (209).

In accordance with one or more embodiments, and as shown in FIG. 2C, the tubular body (202) of the welding tool (200) may comprise at least one nozzle (222) traversing longitudinally through the tubular body (202), and through the base welding element (226), creating a hydraulic connection between the orifice (209) and the external environment of the welding tool (200). The nozzle (222) may be any type of drill bit (112) nozzle, mill bit nozzle, or other nozzle, such as a shearing nozzle, known in the art. In other embodiments, the nozzle (222) may be located on the outer surface of the tubular body (202). In some embodiments, the welding tool (200) does not have a nozzle (222) and mud may exit from the drill string (108) to the external environment via a circulation sub (not shown) installed above the welding tool (200).

Figure 3:
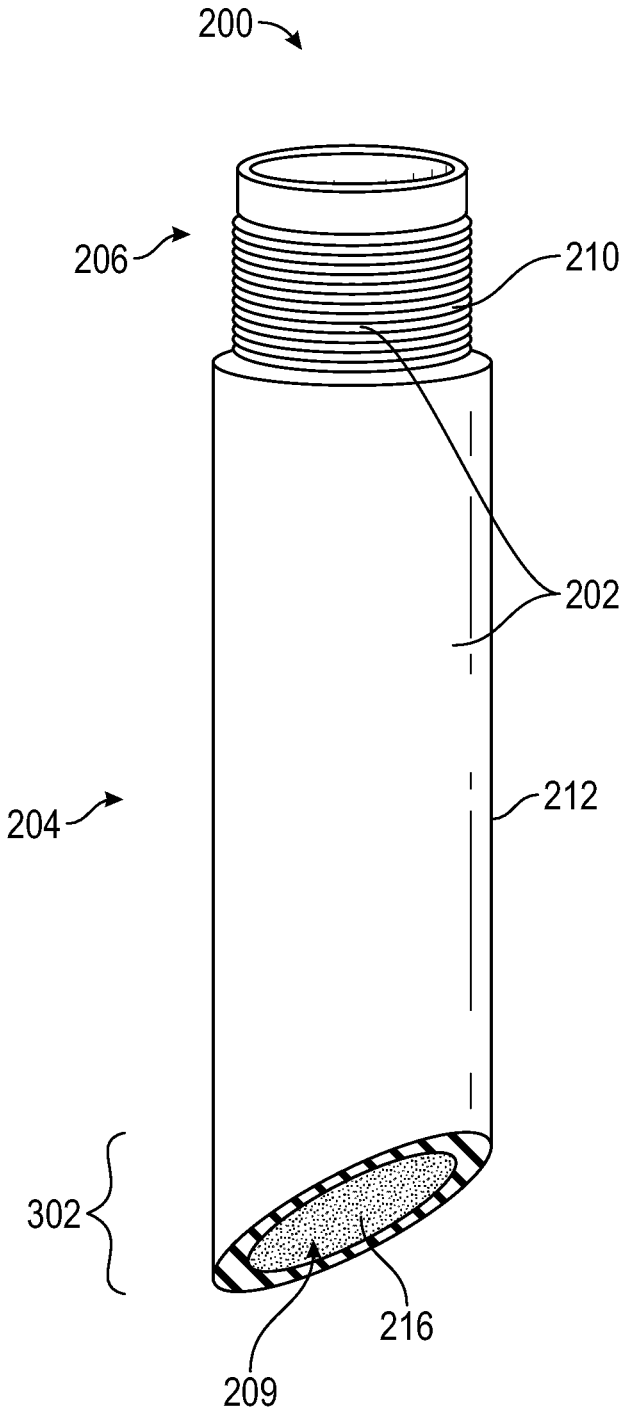
FIG. 3 demonstrates an alternate shape of a welding tool in accordance with one or more embodiments.

FIG. 3 depicts another embodiment of the welding tool (200). Components of FIG. 3 are similar to those of FIGS. 2A-C, and not all components are shown/described for clarity. In this embodiment, the distal end (302) of the lateral end (204), or where the opening for the orifice (209) is located, is shaped to form a "mule shoe guide." The lateral end (204) of the welding tool (200) may be shaped to form a mule shoe guide. Alternatively, only the heat proof shell (212) may be shaped to form a mule shoe guide. In the latter case, a welding tool (200) may be quickly outfitted to provide different shapes by only altering the heat proof shell (212) or selecting a different heat proof shell (212).

Figure 4D:
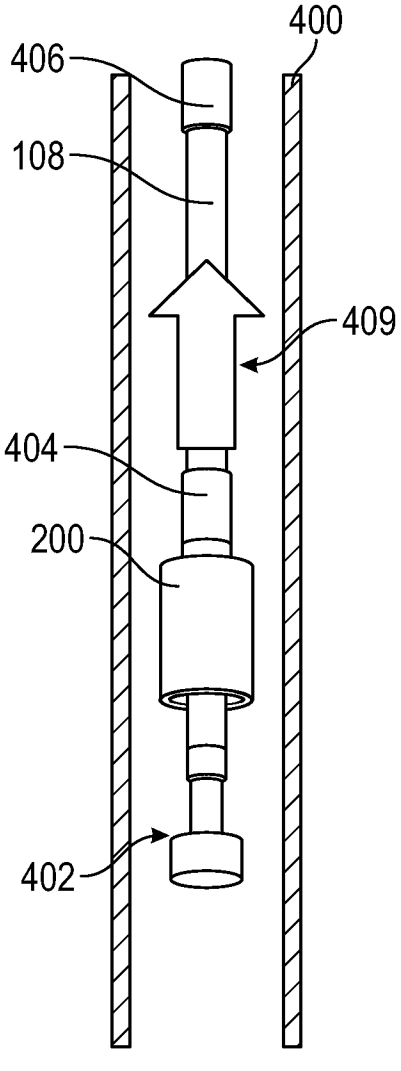
FIGS. 4A, 4B, 4C, and 4D show the welding tool deployed in a well in accordance with one or more embodiments.
Figure 4C:
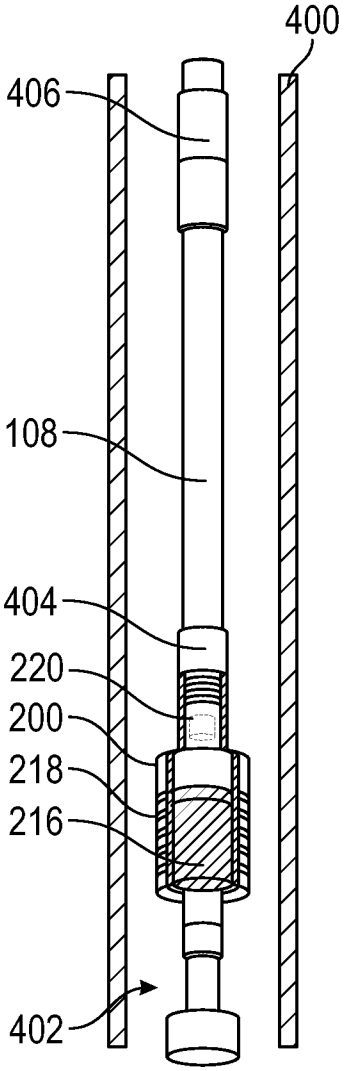
Figure 4B:
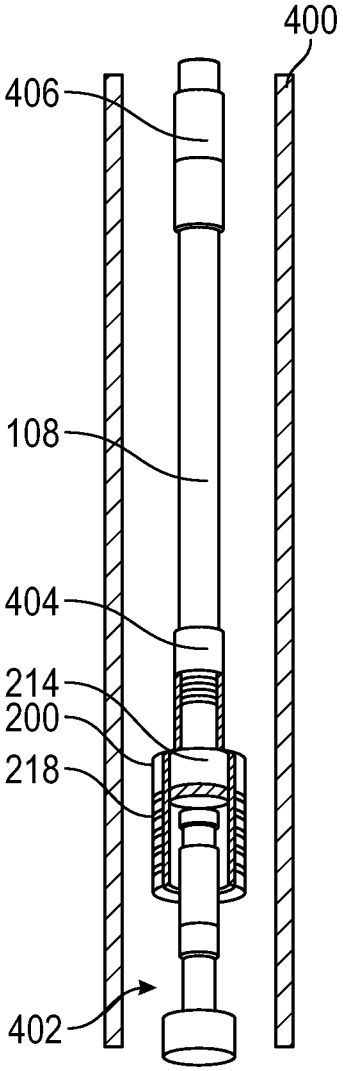
Figure 4A:
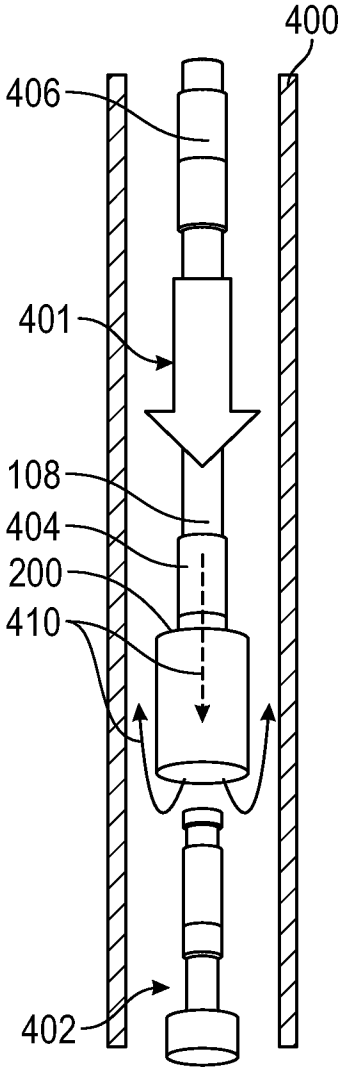

FIGS. 4A, 4B, 4C, and 4D show the welding tool (200) in various phases of deployment in a well (400), in accordance with one or more embodiments. Again, not all components of the welding tool (200), according to FIGS. 2A-C, are shown in FIGS. 4A-D for purposes of readability. More specifically, FIG. 4A shows the welding tool (200) being lowered (401) into the well (400) on a deployment device. The deployment device has a box end (404) with internal thread (not pictured) disposed around an internal circumferential surface (not pictured) of the deployment device.

The deployment demonstrated in FIGS. 4A-D is a drill string (108); however, the deployment device may be any deployment device known in the art, such as coiled tubing. The drill string (108) is shown in FIGS. 4A-D as being connected to the welding tool (200). The external threads (210) of the welding tool (200) interact with the drill string (108) to form a connection between the drill string (108) and welding tool (200). The drill string (108) shown has a BHA (406). The BHA (406) may be a bottom hole assembly similar to the BHA (110) described in FIG. 1 but with components that aid in the fishing and welding operations. As such, the BHA (406) may have a drill collar, a junk basket, a magnet, additional batteries, a safety sub, and/or ajar.

FIG. 4A also shows a drilling fluid (410), or drilling mud, being pumped from the surface of the Earth, through the drill string (108) and out of the distal end (302) of the welding tool (200). Because of the connection formed between the drill string (108) and the welding tool (200), the drilling fluid (410) is free to move from the drill string (108) into the welding tool (200). More specifically, the drilling fluid (410) moves from the drill string (108) to the welding tool (200) and may exit the welding tool (200) to the external environment (which, in this case is the well (400)) through a hydraulic connection provided by a nozzle (222). As previously noted, the welding tool (200) may not have a nozzle (222), in which case the drilling fluid (410) may exit the drill string (108) by other means, such as a circulation sub (not shown). The drilling fluid (410) helps carry cuttings (i.e., broken pieces of the fish (402) or other loose matter) to the surface of the Earth. For clarity, the direction of flow of the drilling fluid (410) is not shown in FIGS. 4B-D, however, it may be present and flowing throughout the fishing operation.

FIGS. 4B and 4C show the drill string (108) and welding tool (200) completely lowered on top of the fish (402) such that a portion of the fish (402) is enclosed by the orifice (209) of the welding tool (200). Contact of the welding tool (200) with the fish (402) may be established by monitoring a weight indicator, as increased weight on tool will be observed when the tool path is obstructed by the fish (402). The fish (402) is shown having a non-uniform portion oriented toward the welding tool (200). FIGS. 4B and 4C depict the locations of the battery housing (214), electric line (218), welding element (216), and controller (220) in accordance with one or more embodiments.

With at least a portion of the fish (402) enclosed by the orifice (209) of the welding tool (200), the controller (220) may receive a mud pulse signal to discharge the stored energy from the batteries to the electric line (218) to heat and melt the welding element (216). The process results in the welding of the fish (402) to the welding tool (200). Once the welding tool (200) is fixedly attached to the fish (402), the welding tool (200) and fish (402) may be raised (409) from the well (400) as depicted in FIG. 4D. It is noted that prior to enveloping the fish (402), or prior to activating the welding tool (200), additional drilling fluid (410) may need to be circulated through the system as an additional cleaning run to ensure that the welding element (216) is free from any particulates that could prohibit adequate welding of the fish (402) to the welding tool (200).

Figure 5:
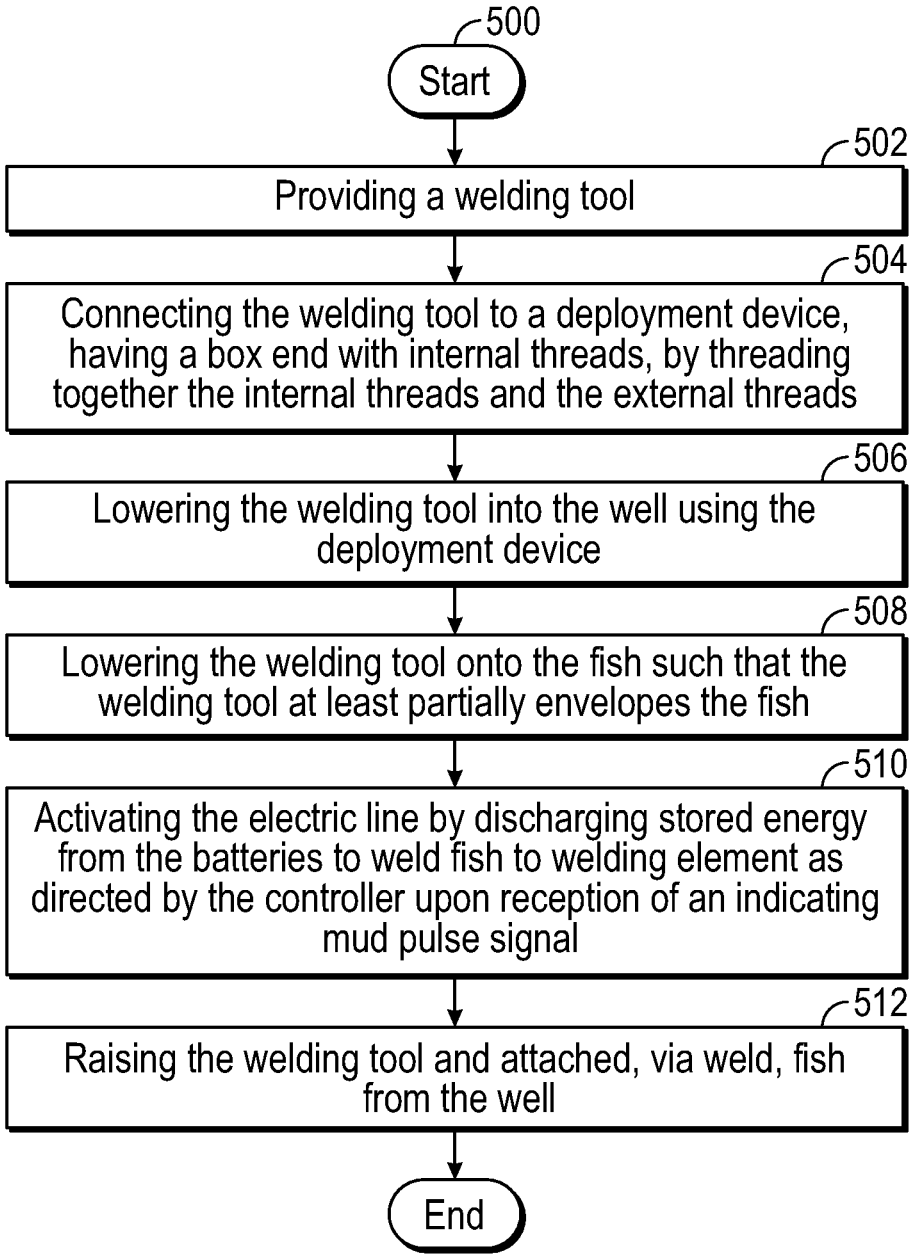
FIG. 5 shows a flowchart in accordance with one or more embodiments.

FIG. 5 depicts a flowchart in accordance with one or more embodiments. In particular, FIG. 5 illustrates a method (500) for removing a fish (402) located in a well (400) via welding the fish (402) to a welding tool (200) inserted into the well (400) and subsequently removing the welding tool (200) from the well (400).

While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, as shown in block 502, a welding tool (200) as described in FIGS. 2A-4C is provided. As described in block 504, the welding tool (200) is connected to a deployment device, having a box end (404) with internal threads, by threading together the internal threads of the box end (404) and the external threads (210) of the pin end (206) of the welding tool (200). In one or more embodiments, the deployment device may be a drill string (108) as shown in FIGS. 4A-D.

The welding tool (200) is lowered into the well (400) using the deployment device according to block 506. The welding tool (200) is further lowered into the well (400) such that the welding tool (200) at least partially envelopes the fish (402), as depicted in block 508.

As illustrated in block 510, the electric line (218) is activated by discharging stored energy from the batteries in order to weld the fish (402) to the welding element (216) as directed by the controller (220) upon reception of a mud pulse signal by the controller (220) wherein the mud pulse signal indicates the activation of the electric line (218).

As shown in block 512, the welding tool (200) and the attached fish (402), where the fish (402) is fixedly attached to the welding tool (200) via a weld, or bond, between the fish (402) and the welding element (216), are raised from the well (400). Note that during the fishing operation a drilling fluid (410) may be pumped from the drill string (108) to the welding tool (200), through at least one nozzle (222), and into the external environment. The environment may be the well (400). In other embodiments, the drilling fluid (410) may carry pieces of the fish (402) to the surface of the Earth. In other embodiments, a junk basket, located in the BHA (406), may catch and carry pieces of the fish (402) to the surface of the Earth.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method for performing a fishing operation, the method comprising:

providing a welding tool comprising:

a tubular body defining a longitudinal axis having a lateral end and a pin end, wherein the tubular body defines an orifice, wherein the orifice has an open side configured to encompass, at least partially, a fish, a battery housing, wherein the battery housing encloses a first battery that stores energy, a welding element deposited on an inner surface of the orifice forming a welding element layer, and an electric line helically coiled about the longitudinal axis and disposed within an annulus of the tubular body, wherein the electric line physically contacts the welding element and is electrically connected to the first battery;

connecting the welding tool to a deployment device;

lowering the welding tool into a well and onto the fish in the well such that the welding tool at least partially envelopes the fish;

activating the electric line to generate heat that welds the fish to the welding element of the welding tool; and raising the welding tool and removing the fish attached via weld to the welding tool from the well.

2. The method of claim 1, wherein the tubular body further comprises at least one nozzle traversing longitudinally through the tubular body creating a hydraulic connection between the orifice and an external environment.

3. The method of claim 2, wherein a fluid is free to move from the deployment device to the welding tool when the hydraulic connection is formed between the welding tool and deployment device.

4. The method of claim 3, wherein lowering the welding tool into the well, activating the electric line, and raising the fish from the well further comprises pumping the fluid through the at least one nozzle to the external environment.

5. The method of claim 1, further comprising sending mud pulse signals from a surface to activate the electric line.

6. The method of claim 1, further comprising receiving, by a controller, mud pulse signals.

7. The method of claim 1, wherein the lateral end of the welding tool is shaped as a mule shoe guide.

8. The method of claim 1, wherein the deployment device comprises a drill string having a bottom hole assembly.

9. The method of claim 8, wherein the bottom hole assembly comprises a drill collar, a junk basket, a magnet, a jar, and a safety sub.

10. The method of claim 8, wherein the bottom hole assembly comprises at a second battery.

* * * * *